US006076436A

United States Patent [19]

Farley

[11] Patent Number: 6,076,436

[45] Date of Patent: Jun. 20, 2000

[54] RETAINING DEVICE WITH METAL INSERT

[76] Inventor: D. Gray Farley, 19205 Woodlands La., Huntington Beach, Calif. 92648

[21] Appl. No.: 09/310,504

[22] Filed: May 12, 1999

[51] Int. Cl.[7] ..... B25B 23/16

[52] U.S. Cl. ..... 81/177.85; 403/324; 403/378

[58] Field of Search ..... 81/177.85, 121.1; 403/294, 324, 378, 379, 408

[56] References Cited

U.S. PATENT DOCUMENTS

| | | | |
|---|---|---|---|
| 1,265,341 | 5/1918 | Keller . | |
| 2,110,397 | 3/1938 | Kangas . | |
| 2,304,038 | 12/1942 | Thompson . | |
| 2,837,381 | 6/1958 | Sarlandt . | |
| 3,549,160 | 12/1970 | Etzkorn | 279/97 |
| 4,266,453 | 5/1981 | Farley . | |
| 4,583,430 | 4/1986 | Farley . | |
| 4,627,761 | 12/1986 | Olson et al. | 403/324 |
| 4,932,293 | 6/1990 | Goff | 18/177.85 |

*Primary Examiner*—James G. Smith
*Assistant Examiner*—David B. Thomas
*Attorney, Agent, or Firm*—Myers, Dawes & Andras LLP

[57] ABSTRACT

The invention is a retaining device to secure a socket to an anvil of a pneumatic air gun. The retaining device comprises an O-ring, a projection, and a metal insert attached to the projection. The O-ring has a diameter and defines a plane. The projection extends inwardly from the O-ring along the plane of the O-ring. The metal insert comprises a near portion, a shoulder portion, and a far portion. The diameter of the near portion is greater than the diameter of the far portion. The far portion, the shoulder portion, and the shear-resistant portion of the near portion all have a solid metal core. The near portion has a hollow core extending from the solid core to a near end of the metal insert. The near portion has at least one aperture opening from the hollow core to the outside surface of the metal tip, and an external annular groove intersecting the aperture. The projection has a predetermined length being less than half the diameter of the O-ring such that the projection and the near portion of the metal insert are disposed in a first bore of the socket, the shoulder portion of the metal insert is disposed in a chamfer portion of a first end of the through-hole of the anvil, and the far portion of the metal insert extends through the first juxtaposition defined by the alignment of the first bore of the socket and the first end of the through-hole of the anvil.

17 Claims, 6 Drawing Sheets

RETAINING DEVICE WITH METAL INSERT

BACKGROUND OF THE INVENTION

1. Field of the Invention

The invention relates to the field of retaining devices adapted for securing sockets to the anvils of large pneumatic air guns.

2. Description of Prior Art

Retaining devices secure power driven sockets to the anvils of power drives. My two patents in this area consist of the Socket Retaining Ring, U.S. Pat. No. 4,266,453, issued in 1981 (the "1981 Patent"), and the Metal Shielded Retaining Ring, U.S. Pat. No. 4,583,430, issued in 1986 (the "1986 Patent").

Prior to the 1981 Patent, power driven sockets were secured to the anvil of a power drive using a metal pin inserted through the bores of the socket aligned with the through-hole of the anvil. To keep the pin in place, a rubber O-ring would be installed around the periphery of the socket, being fitted in an annular groove intersecting and covering the aligned bores.

The most dangerous aspect of this prior art was that workmen would often use the large impact tools by only inserting the pin without using the O-ring. Since the O-ring was separate from the pin, the O-ring could easily get lost, neglected or forgotten. Injury could occur during use when the metal pins were violently dislodged by centrifugal force as a result of a defective O-ring or the lack of the O-ring.

In addition, normal usage of the tool would cause wear and tear of the inner surface of the socket, causing the socket to fit less tightly onto the square end of the anvil. During operation, the worn-out socket would rotate relative to the anvil, creating a "scissors-like" action. This "scissors-like" movement applied a shearing force at two places between the inner surface of the socket and the anvil: 1) the first juxtaposition defined by the alignment of the first bore of the socket with the first end of the through-hole of the anvil; and 2) the second juxtaposition defined by the alignment of the second bore of the socket with the second end of the through-hole of the anvil. This shearing force occasionally caused the metal pin to be jammed in the bores of the socket, creating a major inconvenience as workers would have to drill out the lodged metal pins.

The 1981 patent sought to remedy these problems by making the O-ring and pin a single, integral piece made of elastomeric material. Being a single unit solved the problems caused by separate pieces. As a single unit, a worker could not use the pin without the O-ring, nor the O-ring without the pin. Furthermore, since the pin consisted of the same elastomeric material as the O-ring, workers no longer had to struggle with removing metal pins jammed at the bores of the socket.

However, rotational movement of the socket relative to the anvil would still occur as part of normal use. This rotational movement caused shearing of the elastomeric pin at the two juxtapositions.

The 1986 patent improved upon the 1981 patent by including a metal sleeve covering a portion of the elastomeric pin. The 1986 patent teaches placing a metal sleeve around the far end of the pin adjacent to the second juxtaposition, which is the juxtaposition furthest away from the base of the pin. Using the metal sleeve improved the safety of the completely polyurethane retaining device. However, since the metal sleeve was hollow, it could not withstand a strong shearing force. In such case, the shearing force could crush or shatter the metal sleeve, destroying the safety of the ring as well as making it very difficult to remove.

Furthermore, the metal sleeve in the 1986 patent covered only the portion of the pin adjacent to the second juxtaposition, leaving the portion of the elastomeric pin adjacent to the first juxtaposition without function. Since the elastomeric portion would be exposed to the shearing force after the failure of the metal sleeve, the shearing force would easily shear the elastomeric material at both juxtapositions, severing the pin from the O-ring and rendering the entire retaining device useless and unsafe.

Furthermore, both the 1981 and 1986 patents include a pin whose length is substantially close to the diameter of the O-ring itself. The long pin causes major difficulty for the user in insertion and removal. First, the long pin requires a user to pull a portion of the O-ring adjacent to the pin back far enough so that the tip of the long pin can enter the first bore of the socket. Second, the long pin requires the user to insert the pin all the way through so that it: 1) traverses the first bore of the socket to the first end of the through-hole of the anvil (i.e. the first juxtaposition), 2) traverses all the way across the through-hole of the anvil, and 3) exits the second end of the through-hole and enters the second bore of the socket (i.e. the second juxtaposition). Likewise, to remove the pin, the user would have to pull the O-ring back far enough so that the entire pin can exit the first bore from which it entered. The length of the pin makes insertion and removal inconvenient as the pin would have to traverse through both juxtapositions.

The prior art does not disclose a retaining device that can satisfactorily withstand the shearing force between the socket and anvil. Obviously, a ring that could withstand the shearing force would last longer and provide greater safety. Furthermore, the prior art teaches a retaining device that is inconvenient to insert and remove.

Therefore, what is needed is a retaining device that 1) will not be jammed, sheared or crushed upon normal usage;
2) will be easier to insert and remove than the prior art; and
3) will allow greater shear resistance with a larger solid steel insert that is substantially stronger and safer.

BRIEF SUMMARY OF THE INVENTION

The invention is a retaining device adapted for securing a socket to the anvil of a power drive or pneumatic air gun.

The socket has a first and second bore and an annular socket groove intersecting the bores while the anvil has a through-hole with a first and second end, the first and second end of the through-hole each having a chamfer portion. When the socket is mounted on the anvil, the anvil's bores are aligned with the socket's through-hole. The alignment of the first bore with the first end of the through-hole defines a first juxtaposition between the socket and the anvil, while the alignment of the second bore with the second end of the through-hole defines a second juxtaposition.

The retaining device comprises an O-ring, a projection extending inwardly from the O-ring, and a metal insert at a far end of the projection. The O-ring defines a plane and has a diameter adapted for wrapping around the annular socket groove. The projection has a near and far end. The projection is connected to, or integral with, the O-ring at the near end. The projection extends inwardly from the O-ring along the plane of the O-ring. The projection is disposed in the first bore of the socket. The projection has a predetermined length less than half the diameter of the O-ring such that the metal insert extends through the first juxtaposition. The O-ring and the projection that supports the metal insert comprise an elastomeric material.

The metal insert comprises a near portion having a first diameter, a shoulder portion, and a far portion having a second diameter. The shoulder portion is disposed between the near portion and the far portion. The near portion is attached to the far end of the projection. The first diameter of the near portion is greater than the second diameter of the far portion. The far portion, the shoulder portion, and a shear-resistant portion of the near portion all have a solid metal core. The near portion also has a hollow core. The near portion has at least one aperture opening from the hollow core to an outside side surface of the metal insert. The near portion has an external annular groove intersecting the aperture. The metal insert has a round tip. The predetermined length of the projection is such that the shoulder portion of the metal insert is disposed in the chamfer portion of the first end of the through-hole.

The metal insert is attached to the far end of the projection. The metal insert is attached to the projection by the elastomeric material of the projection filling the hollow core, aperture and external annular groove of the metal insert. In a preferred embodiment, the elastomeric material of the projection is molded into the metal insert.

In a second embodiment, the projection has a predetermined length less than half the diameter of the O-ring such that: (1) the projection and the near portion of the metal insert are disposed in the first bore of the socket; (2) the shoulder portion of the metal insert is disposed in the chamfer portion of the first end of the through-hole; and (3) the solid far portion of the metal insert extends through the first juxtaposition.

Therefore, in summary it can be appreciated that the invention greatly increases safety and saves time by eliminating jamming, shearing or crushing of the pin commonly associated with the prior art. Since workers need not attempt to remove crushed or jammed pins, the invention saves time. The invention greatly reduces financial costs as the average life of the present invention will outlast and provide greater safety than the prior art using the hollow metal sleeve.

The invention, now having been briefly summarized, may be better visualized by turning to the following drawings wherein like elements are referenced by like numerals.

The invention and its various embodiments can now be better understood by turning to the following detailed description wherein an illustrated embodiment is described. It is to be expressly understood that the illustrated embodiment is set forth as an example and not by way of a limitation to the invention as defined in the following claims.

DETAILED DESCRIPTION OF THE PREFERRED EMBODIMENTS

Figure 1:
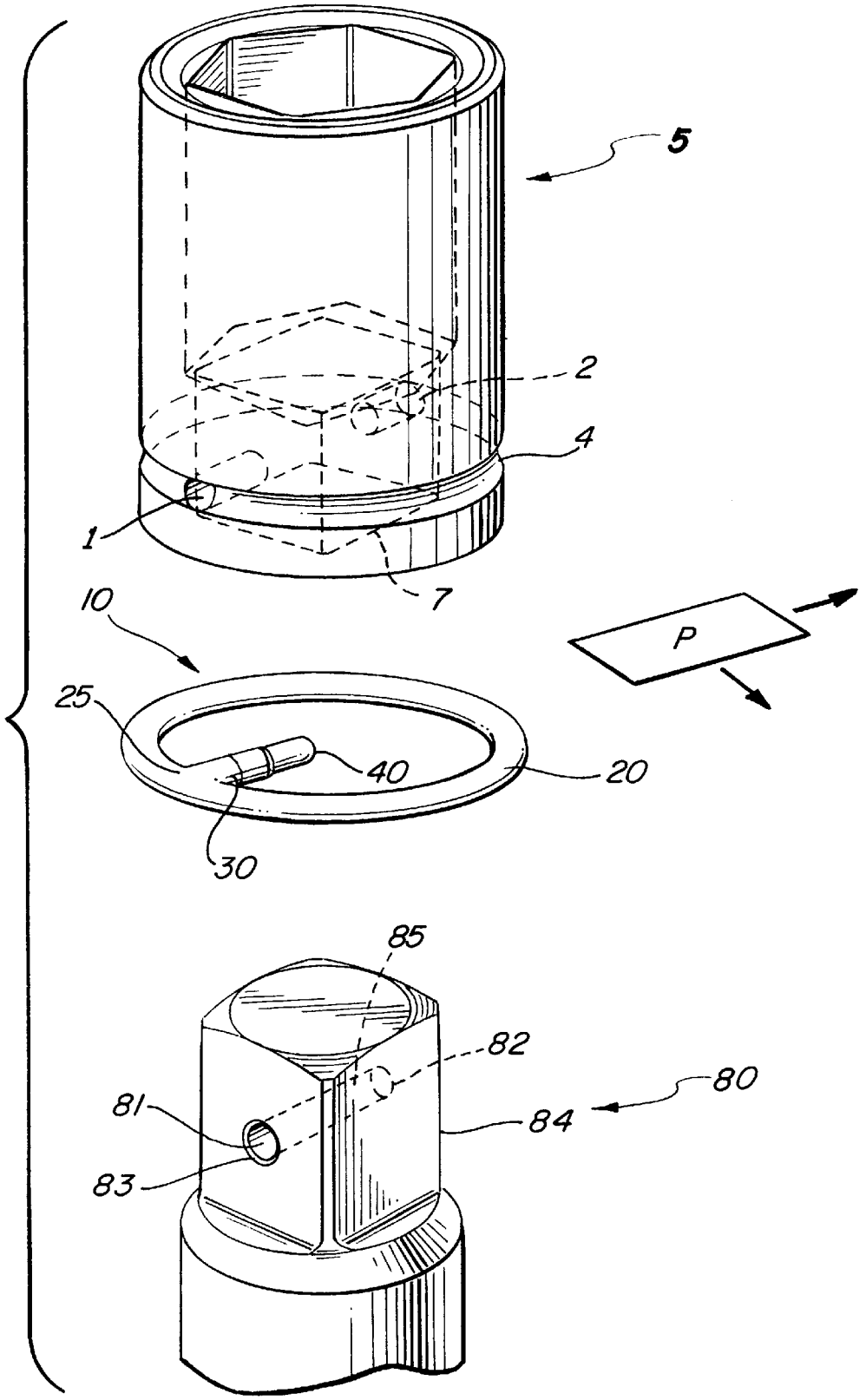
FIG. 1 is an exploded perspective view of the socket, the retaining device and the anvil with hidden view lines.

FIG. 1 is an exploded perspective view of a socket 5, an anvil 80 for a large impact tool (not shown), and a retaining device 10 according to this invention. The socket 5 has a square hole 7, an annular socket groove 4, and first and second bores 1, 2 that extend between the groove 4 and the square hole 7. The anvil 80 has a square end 84 with a through-hole 85 having a first end 81 and a second end 82. Both the first end 81 and the second end 82 each have a chamfer portion 83. To secure the socket 5 to the anvil 80, the socket 's square hole 7 is mounted onto the anvil's square end 84 such that the socket's first and second bores 1, 2 align with the first and second ends 81, 82 of the anvil's through-hole 85.

The retaining device 10 generally includes an O-ring 20, a projection 30, and a metal insert 40. To install the retaining device 10, the O-ring 20 is placed over the anvil 80. The socket 5 is mounted on the anvil 80. A portion 25 of the O-ring 20 adjacent to the projection 30 is pulled away from the socket 5 such that the metal insert 40 and the projection 30 can enter the first bore 1 of the socket 5. The O-ring 20 is then pulled up over the socket 5 and seated into the annular socket groove 4.

Figure 2:
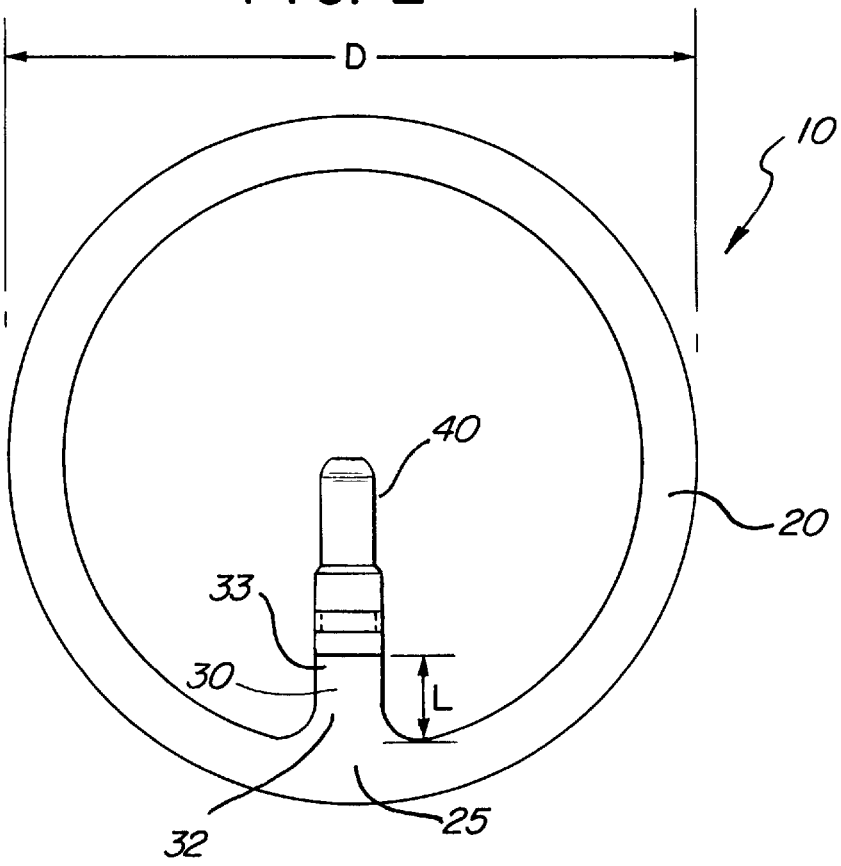
FIG. 2 is an elevational view of the retaining device.

FIG. 2 is a plan view of the retaining device 10. The retaining device 10 comprises an O-ring 20 made of an elastomeric material such as polyurethane. The O-ring has a diameter "D" and defines a plane "P" (shown in FIG. 1). The retaining device 10 has a projection 30 with a length "L". The projection 30 extends inwardly from the O-ring 20 along the plane P of the O-ring 20 (as shown in FIG. 1). In the preferred embodiment, the projection 30 is made of the same elastomeric material as the O-ring 20 and is integral with the O-ring 20 at a portion 25 of the O-ring 20. The projection 30 has a near end 32 and a far end 33. Attached to the far end 33 of the projection 30 is a metal insert 40.

Figure 3:
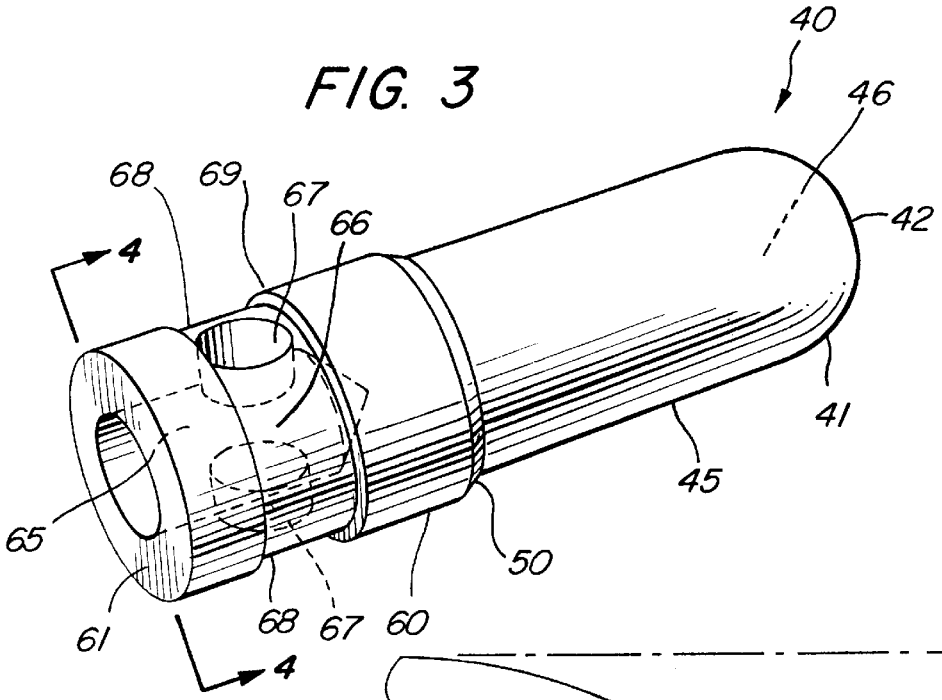
FIG. 3 is a perspective view of the metal insert with hidden view lines.

FIG. 3 is a perspective view of the preferred metal insert 40 with hidden view lines. The metal insert 40 has a far portion 45 located at a far end 41, a shoulder portion 50, and a near portion 60 located at a near end 61. The far portion 45 and the shoulder portion 50 have a solid metal core 46. The far portion also comprises a round tip 42 at the far end 41. The shoulder portion 50 is disposed between the far portion 45 and the near portion 60.

Figure 4:
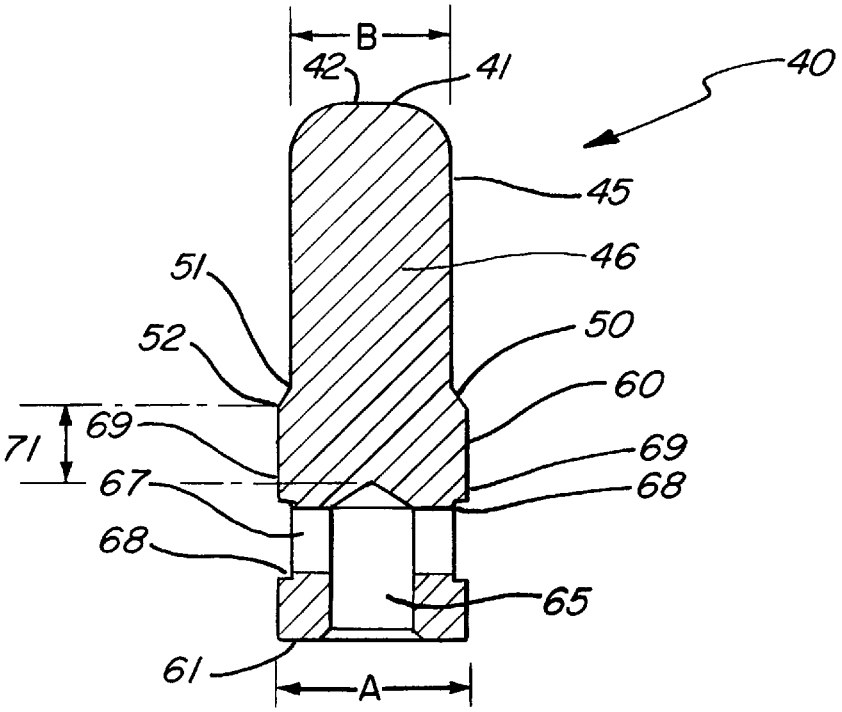
FIG. 4 is a sectional side view of the metal insert taken along lines 4—4 of FIG. 3.

FIG. 4 is a sectional side view of the metal insert 40 taken along lines 4—4 of FIG. 3. The near portion 60 has a first diameter "A" that is larger than the second diameter "B" of the far portion 45. Likewise, the diameter of the shoulder portion 50 increases from a far end 51 to a near end 52. The near portion 60 has a shear-resistant portion 71 which has the solid core 46. The far portion 45, shoulder portion 50, and the shear-resistant portion 71 all have the solid metal core 46. The shear resistant portion 71 extends from a near end 52 of the shoulder portion 50 to the hollow core 65. The near portion 60 has a hollow core 65 which extends up from a near end 61 of metal insert 40 to the solid core 46. The near portion 60 has at least one or more apertures 67 opening from the hollow core 65 to the outer surface 69 of the metal insert 40. An external annular groove 68 in the near portion 60 intersects the apertures 67.

Figure 5:
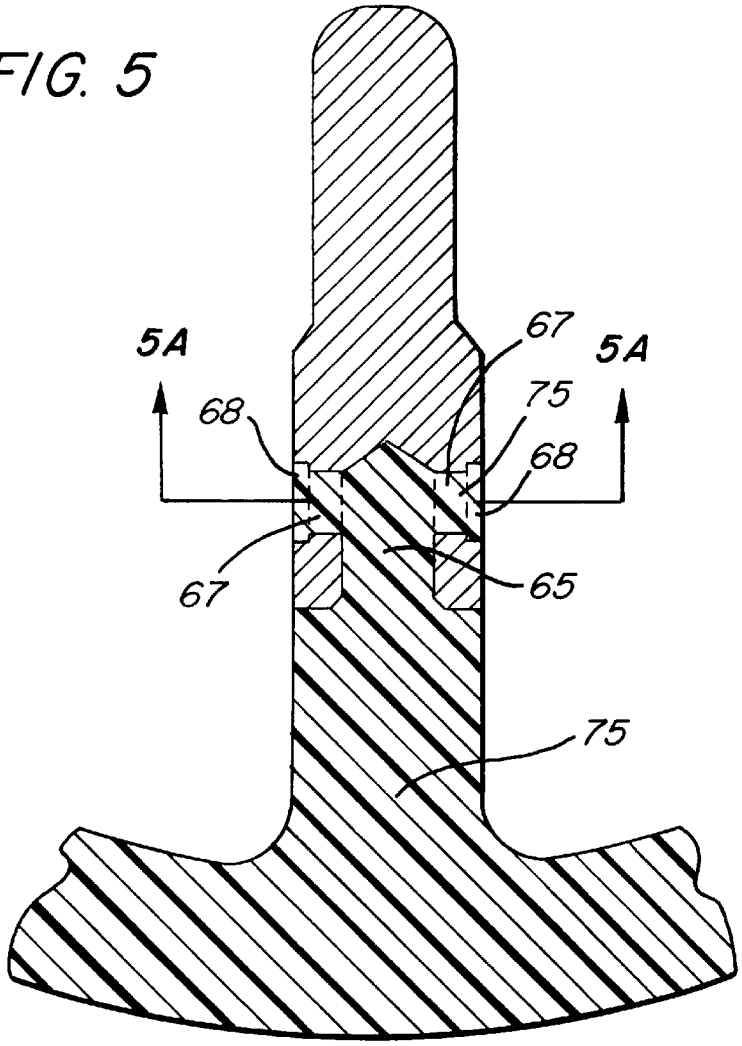
FIG. 5 is a sectional side view of the metal insert filled with the elastomeric material, as taken along lines 4—4 of FIG. 3.

FIG. 5 is sectional side view of the metal insert 40, taken along lines 4—4 of FIG. 3, as it is filled with the elastomeric material 75. Thus, in the formation of the retaining device 10, the molded elastomeric material 75 forming the O-ring 20 and the projection 30 will fill the hollow core 65, extrude through the apertures 67, and fill the external annular groove 68.

Figure 5A:
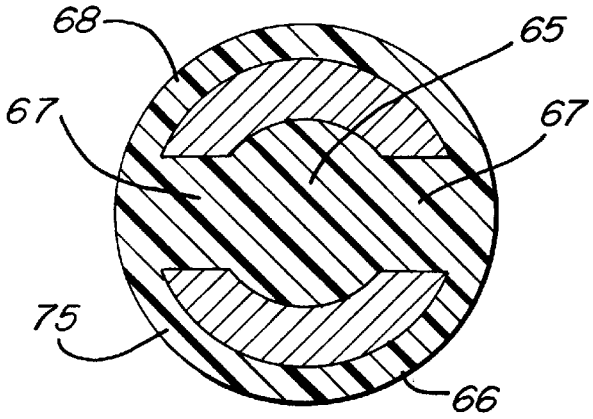
FIG. 5*a* is a sectional view of the metal insert filled with the elastomeric material, as taken along lines 5*a*—5*a* of FIG. 5.

FIG. 5*a* is sectional view, as taken along lines 5*a*—5*a* of FIG. 5, of the metal insert 40 with the elastomeric 75. As the elastomeric material 75 fills the external annular groove 68, the elastomeric material 75 forms an annular wrap 66, providing a secure attachment of the metal insert 40 to the projection 30.

Figure 6:
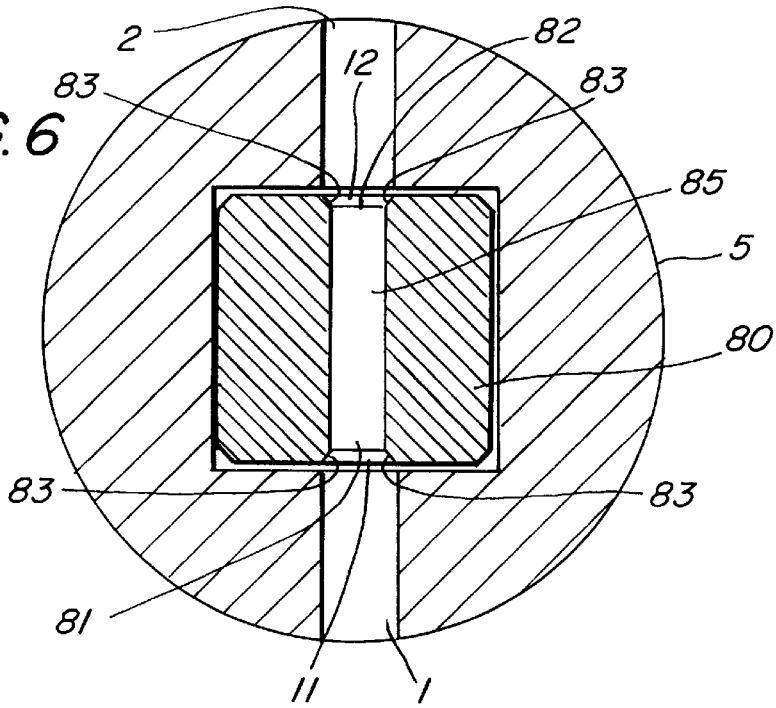
FIG. 6 is a sectional end view of the socket mounted onto the anvil without the retaining device.

FIG. 6 is a sectional end view of the socket 5 mounted onto the anvil 80 without the retaining device. The alignment of the first bore 1 of the socket 5 with the first end 81 of the through-hole 85 defines a first juxtaposition 11. The alignment of the second bore 2 of the socket 5 with the second end 82 of the through-hole 85 defines a second juxtaposition 12.

Figure 7:
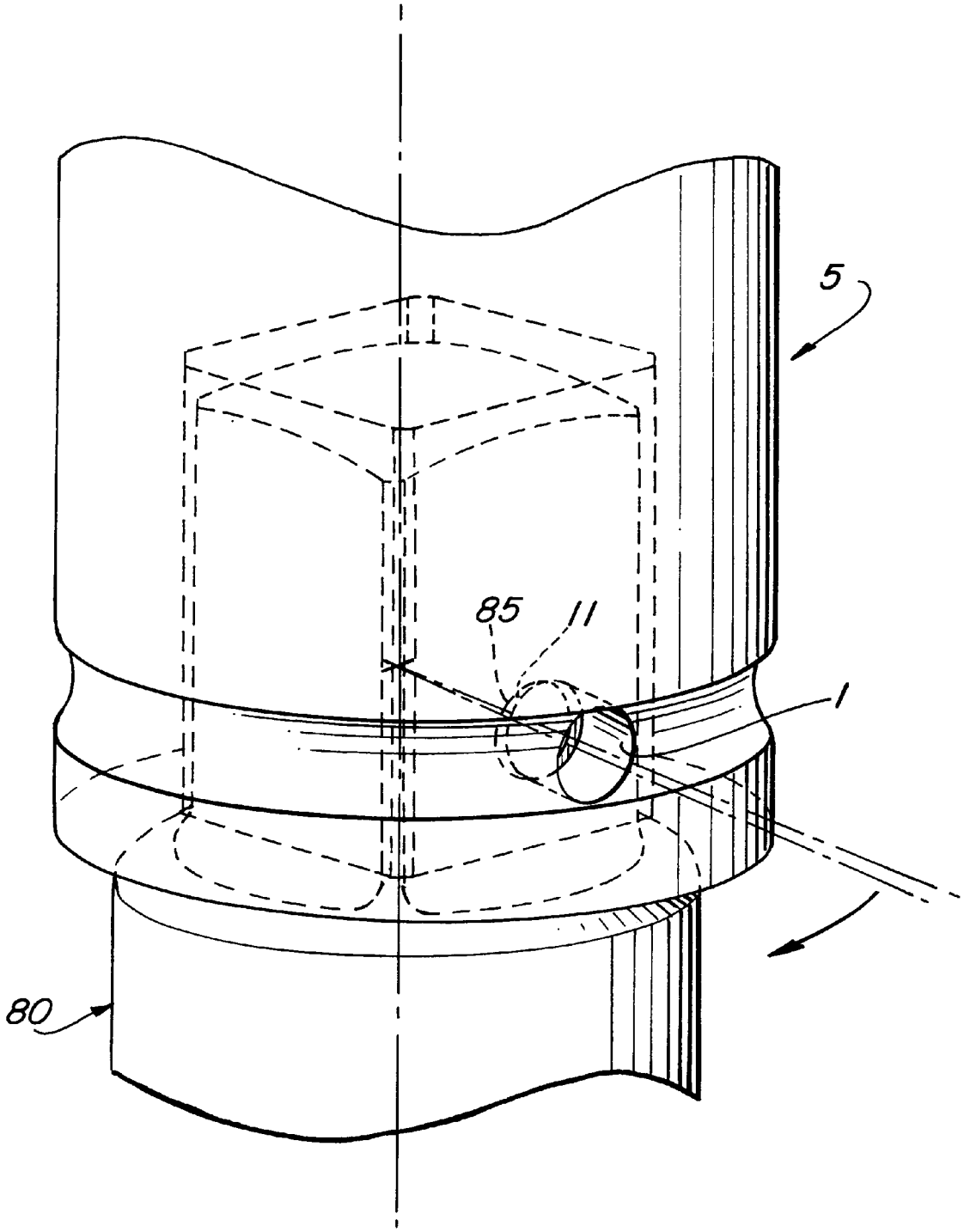
FIG. 7 is plan view of the socket mounted to the anvil, showing misalignment of the bore of the socket with the through-hole of the anvil.

FIG. 7 is plan view of the socket 5 mounted to the anvil 80, showing misalignment of the first bore 1 of the socket 5 with the through-hole 85 of the anvil (not shown). This misalignment causes a shearing force between the socket 5 and the through-hole 85 at the first juxtaposition 11.

Figure 8:
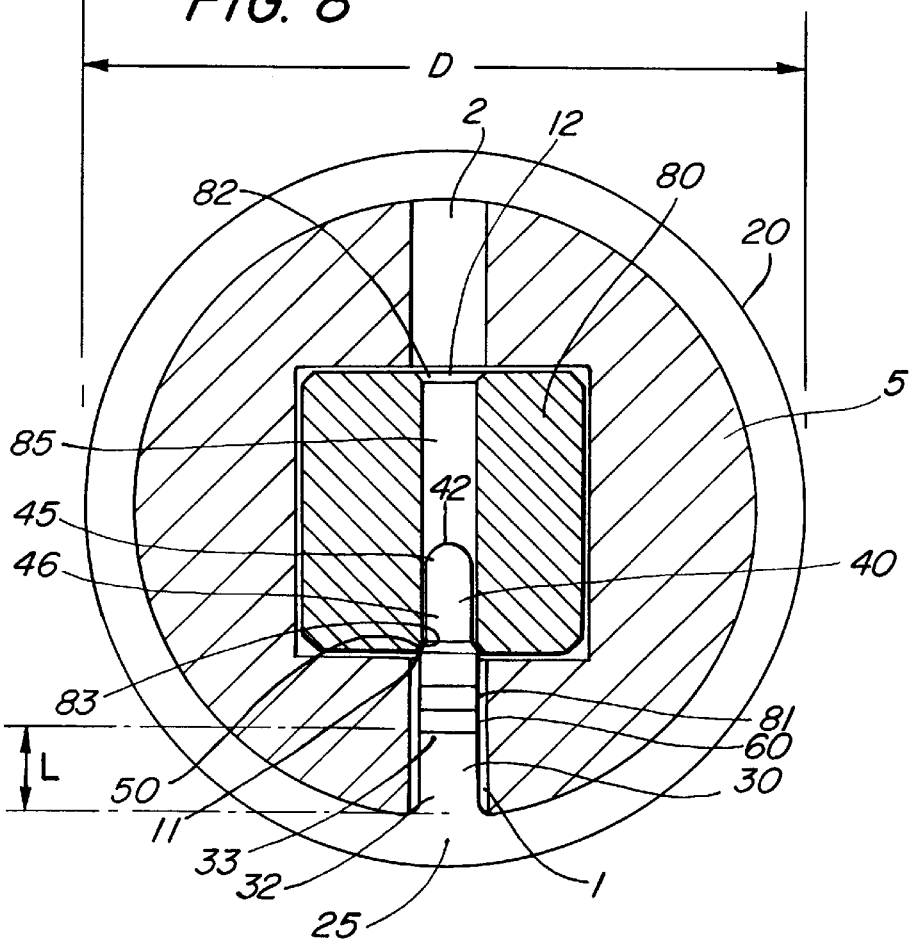
FIG. 8 is a sectional end view of the retaining device securing the socket to the anvil.

FIG. 8 is a sectional end view of the retaining device 10 securing the socket 5 to the anvil 80. As shown, the projection 30 enters through the first bore 1. The predetermined length "L" of the projection 30 is less than one-half the diameter "D" of the O-ring 20 such that: (1) the projection 30 and the near portion 60 of the metal insert 40 are disposed in the first bore 1 of the socket 5; (2) the shoulder portion 50 of the metal insert 40 is disposed in the chamfer portion 83 of the first end 81 of the through-hole 85; and (3) the far portion 45 of the metal insert 40 extends through the first juxtaposition 11. Significantly, the far portion 45 of the metal insert 40 does not extend through the second juxtaposition 12.

Any shearing force applied at the first juxtaposition 11 may encounter the far portion 45, the shoulder portion 50 and the shear resistant portion 71 of the metal insert 40, all of which have a solid metal core 46. The solid metal core 46 will withstand a greater shearing force than a hollow metal sleeve, and will more likely prevent any shearing, crushing or jamming. Since the metal insert 40 does not extend through the second juxtaposition 12, any shearing force applied at the second juxtaposition 12 will not contact any part of the retaining device 10 and the metal insert 40 will not be detrimentally jammed at the far, second juxtaposition 12.

The round tip 42 makes the metal insert 40 self-inserting as the tip 42 encounters and traverses over rough edges and obstacles, such as when the first bore 1 of the socket 5 does not line up perfectly with the first end 81 of the through-hole 85 of the anvil 80 as shown in FIG. 7. The smooth insertion caused by the round tip 42 coupled with the resting of the shoulder portion 50 of the metal insert 40 in the chamfer portion 83 of the anvil 80 makes the retaining device 10 self-guiding upon insertion.

Figure 9:
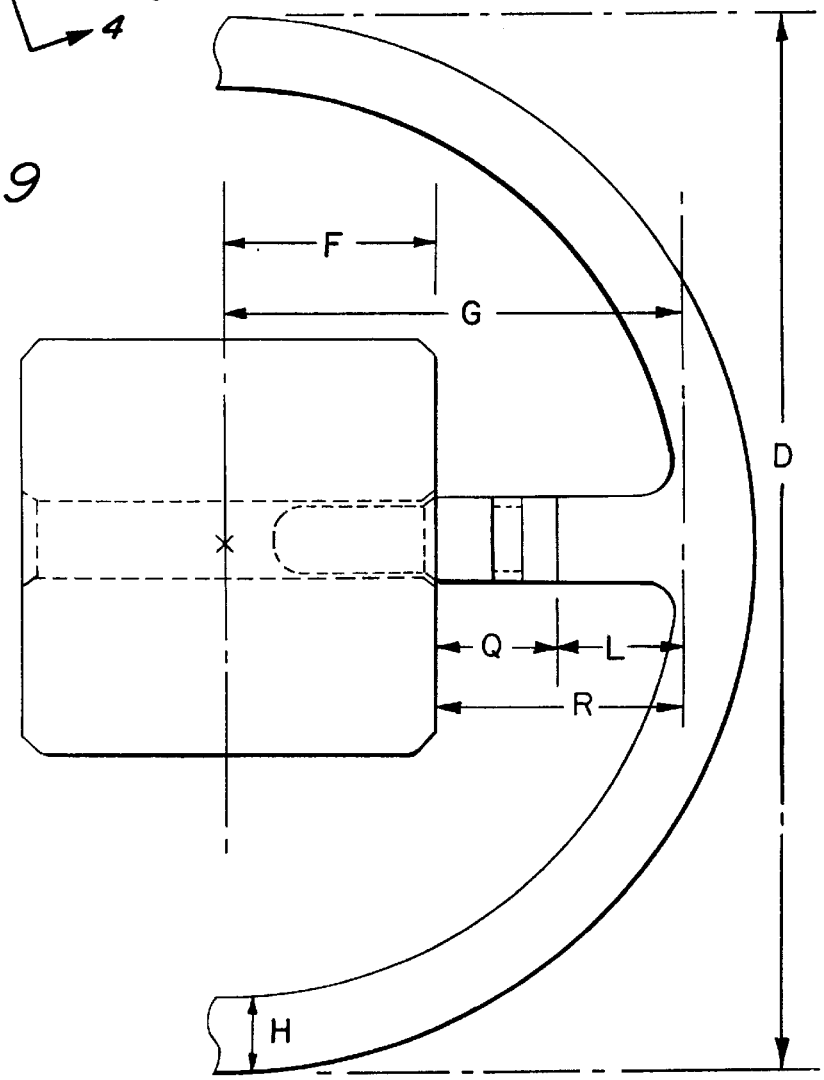
FIG. 9 is a plan view of the retaining device and the anvil without the socket.

FIG. 9 is a plan view of the retaining device 10 and the anvil 80. The socket is not shown. In the preferred embodiment of the invention, the size of the metal insert 40 remains the same for each anvil size in spite of varying sizes of sockets. However, the diameters and dimensions of the metal insert 40 will change with the ¾ inch, 1 inch and 1½ inch square drive anvil sizes used on most larger impact wrenches. The relative design and function will not change. What differs is the length "L" of the projection 30, which must be predetermined so that the shoulder portion 50 of the metal insert 40 is disposed in the chamfer portion 83 of the first end 81 of the through-hole 85. Thus, manufacturing is simplified as the metal insert 40 can remain uniform, while the O-ring 20 and the projection 30 vary depending upon the size of the socket (not shown) and the anvil 80. Of course, one could vary the sizes of the metal insert 40 without departing from the spirit and scope of the invention.

The following tables suggest specifications for retaining devices per socket size. Each table corresponds to a different size anvil.

| Socket radius | Length of projection-"L" | Diam. of near portion of metal insert-"M" | Cross-section of O-ring-"H" | Diameter "D" of retaining device |
|---|---|---|---|---|
| | | ¾" Anvil | | |
| .625 | 0 | .225 | .175 | 1.600 |
| .719 | .094 | .225 | .175 | 1.788 |
| .813 | .188 | .225 | .175 | 1.975 |
| .875 | .250 | .225 | .175 | 2.100 |
| 1.000 | .375 | .225 | .175 | 2.350 |
| 1.062 | .435 | .225 | .175 | 2.475 |
| 1.125 | .500 | .225 | .175 | 2.600 |
| | | 1" Anvil | | |
| .875 | 0 | .250 | .200 | 2.150 |
| 1.000 | .125 | .250 | .200 | 2.400 |
| 1.063 | .187 | .250 | .200 | 2.525 |
| 1.125 | .250 | .250 | .200 | 2.650 |
| 1.250 | .375 | .250 | .200 | 2.900 |
| 1.313 | .438 | .250 | .200 | 3.025 |
| | | 1½" Anvil | | |
| 1.437 | .187 | .350 | .230 | 3.335 |

-continued

| Socket radius | Length of projection-"L" | Diam. of near portion of metal insert-"M" | Cross-section of O-ring-"H" | Diameter "D" of retaining device |
|---|---|---|---|---|
| 1.687 | .437 | .350 | .230 | 3.835 |
| 1.937 | .687 | .350 | .230 | 4.335 |
| 2.187 | .937 | .350 | .230 | 4.835 |

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The claims are thus to be understood to include what is specifically illustrated and described above, what is conceptionally equivalent, what can be obviously substituted and also what essentially incorporates the essential idea of the invention.

I claim:

1. A retaining device to secure a socket to an anvil, the socket having a first and second bore and an annular socket groove intersecting the bores, the anvil having a through-hole with a first and second end, the first and second end of the through-hole each having a chamfer portion, the bores being aligned with the through-hole, the alignment of the first bore with the first end of the through-hole defining a first juxtaposition between the socket and the anvil, the alignment of the second bore with the second end of the through-hole defining a second juxtaposition between the socket and the anvil, the retaining device comprising:

an O-ring having a diameter adapted for wrapping around the annular socket groove, the O-ring defining a plane;

a metal insert; and a projection having a near end and a far end, the projection being connected to the O-ring at the near end, the projection extending inwardly from the O-ring along the plane of the O-ring, the metal insert being attached to the far end of the projection, the projection being disposed in the first bore of the socket, the projection having a predetermined length less than half the diameter of the O-ring such that the metal insert extends through the first juxtaposition.

2. The retaining device of claim 1 wherein the O-ring comprises an elastomeric material.

3. The retaining device of claim 2 wherein the projection comprises an elastomeric material, the projection being integral with the O-ring.

4. The retaining device of claim 1 wherein the metal insert comprises a near portion having a first diameter, a shoulder portion, and a far portion having a second diameter, wherein the shoulder portion is disposed between the near portion and the far portion, the near portion being attached to the far end of the projection.

5. The retaining device of claim 4 wherein the first diameter of the near portion is greater than the second diameter of the far portion.

6. The retaining device of claim 5 wherein the predetermined length of the projection is such that the shoulder portion of the metal insert is disposed in the chamfer portion of the first end of the through-hole.

7. The retaining device of claim 5 wherein the near portion has a hollow core, and wherein the far portion and the shoulder portion have a solid metal core.

8. The retaining device of claim 7 wherein the near portion has at least one aperture opening from the hollow core to an outer surface of the metal insert.

9. The retaining device of claim 8 wherein the near portion has an external annular groove intersecting the aperture, the metal insert being attached to the projection by the elastomeric material of the projection filling the hollow core, aperture and external annular groove of the metal insert.

10. The retaining device of claim 9 wherein the predetermined length of the projection is such that the shoulder portion of the metal insert is disposed in the chamfer portion of the first end of the through-hole.

11. The retaining device of claim 7 wherein the near portion of the metal insert has a shear resistant portion extending from a near end of the shoulder portion to the hollow core, the shear resistant portion having the solid core, the hollow core extending from a near end of the metal insert to the solid core.

12. The retaining device of claim 1 wherein the metal insert is solid.

13. The retaining device of claim 11 wherein the metal insert has a rounded tip.

14. A retaining device adapted for securing a socket to an anvil of a pneumatic air gun, the socket having a first and second bore and an annular socket groove intersecting the bores, the anvil having a through-hole with a first and second end, the first and second end of the through-hole each having a chamfer portion, the bores of the socket being aligned with the through-hole of the anvil, the alignment of the first bore with the first end of the through-hole defining a first juxtaposition between the socket and the anvil, the alignment of the second bore with the second end of the through-hole defining a second juxtaposition between the socket and the anvil, the retaining device comprising:

an O-ring comprising an elastomeric material, the O-ring having a diameter adapted for wrapping around the annular socket groove, the O-ring defining a plane;

a metal insert comprising a near portion with a first diameter, a shoulder portion, and a far portion with a second diameter, the first diameter of the near portion being larger than the second diameter of the far portion, the shoulder portion being disposed between the near portion and the far portion, the near portion comprising a shear resistant portion, a hollow core and an aperture opening from the hollow core to an outer surface of the metal insert, the near portion having an external annular groove intersecting the aperture, the shear resistant portion extending from a near end of the shoulder portion to the hollow core, the hollow core extending from the shear-resistant portion to a near end of the metal insert, the far portion, the shoulder portion and the shear-resistant portion comprising a substantially solid metal core; and a projection having a near end and a far end, the projection being integral with the O-ring, the projection comprising the same elastomeric material as the O-ring, the projection extending inwardly from the O-ring by a predetermined length to the far end, the projection extending along the plane of the O-ring, the metal insert being attached to the far end of the projection by the elastomeric material of the projection filling the hollow core, aperture and external annular groove of the metal insert, the predetermined length of the projection being less than half the diameter of the O-ring such that the projection and the near portion of the metal insert are disposed in the first bore of the socket, the shoulder portion of the metal insert is disposed in the chamfer portion of the first end of the through-hole, and the far portion of the metal insert extends through the first juxtaposition.

15. The retaining device of claim 14 wherein the near portion comprises two or more apertures, the external annular groove intersecting the apertures.

16. The retaining device of claim 14 wherein the metal insert comprises a round tip.

17. The retaining device of claim 14 wherein the elastomeric material comprises polyurethane.

* * * * *